US006128791A

United States Patent [19]

Brocking

[11] Patent Number: 6,128,791

[45] Date of Patent: Oct. 10, 2000

[54] SWIMMING POOL COVER DRAINAGE APPARATUS

[76] Inventor: Brent E. Brocking, 14 Arverne Rd., Sound Beach, N.Y. 11789

[21] Appl. No.: 09/365,259

[22] Filed: Jul. 31, 1999

[51] Int. Cl.[7] ..... E04H 4/00

[52] U.S. Cl. ..... 4/498; 4/496

[58] Field of Search ..... 4/498, 490, 496, 4/507, 509, 499, 500, 503, 504; 210/169, 416.2, 242.1, 527.1; 137/312, 313, 314; 220/219

[56] References Cited

U.S. PATENT DOCUMENTS

| | | | |
|---|---|---|---|
| 4,233,695 | 11/1980 | Rowney | 4/498 |
| 5,038,419 | 8/1991 | MacDonald | 4/502 |
| 5,259,078 | 11/1993 | Crandall | 4/503 |
| 5,722,098 | 3/1998 | Stera | 4/498 |
| 5,802,629 | 9/1998 | Zietek | 4/498 |
| 5,946,743 | 9/1999 | Hashmi | 4/498 |

*Primary Examiner*—Henry J. Recla
*Assistant Examiner*—Huyen Le

[57] ABSTRACT

A drainage apparatus providing for a self-draining pool cover on a typical pool (13). The pool skimmer unit (18) is unfastened and removed from the pool wall (8). The pool water (14) at the height to the bottom of the skimmer opening (15) in the pool wall (8) allowing for the drainage of water, leaves, residue, and debris off of the pool cover (3) by gravity through an aperture (11) in the pool cover (3) sandwiched between the assembled drainage apparatus (5) having an aperture (11) aligned to the perimeter of the skimmer opening (15) with a skimmer gasket (6) on the inside pool wall (8) secured to the perimeter of the skimmer opening (15) in the pool wall (8) by use of a skimmer gasket (6) and a skimmer apparatus (9) aligned on the out-side pool wall (8) to the perimeter of the skimmer opening (15) secured together to the perimeter of the skimmer opening (15) in the pool wall (8) by the use of male fasteners (10) inserted through the fasteners passageways (17) secured to female fasteners (16).

5 Claims, 3 Drawing Sheets

SWIMMING POOL COVER DRAINAGE APPARATUS

BACKGROUND

1. Field of Invention

The present invention relates to a drainage apparatus, specifically to a self-draining pool cover drainage apparatus providing for drainage of water, leaves, residue, and debris off of a swimming pool cover by means of gravity through a skimmer opening in a side-wall of a pool. The present invention provides for a self-draining pool cover eliminating the potential for accumulation of water, leaves, residue, and debris on said swimming pool cover during the off-season that the pool is not in use.

2. Description of Prior Art

Swimming pool covers are known in the art. Swimming pool covers are commonly used to cover pools during the off season when pools are not in use to prevent the ingress of water, leaves, residue, and other debris. U.S. Pat. No. 5,802,629 relates to a self-draining pool cover for the removal through gravity means of the accumulations of water, dirt, and other residue which can collect during the off-season that a pool is not in use. An aperture located in the surface area of a pool cover is positioned in the pool at a lower elevation than the remaining pool cover to remove accumulations from the pool cover by gravity. In addition, there are conduit means for disposing the accumulations including an outlet in a wall of the pool.

U.S. Pat. No. 5,802,629 suffers from a number of disadvantages:

a) Large debris drawn by means of gravity to the pool cover's aperture that cannot be disposed of through the pool cover's aperture by means of gravity will result in a backup of leaves and other residue on the pool cover restricting the disposal of water and other residue through the pool cover's aperture.

b) Large debris drawn by means of gravity through the pool cover's aperture can become lodged in the conduit means and/or the outlet assembly resulting in a backup of leaves and other residue restricting the disposal of water and other residue on the pool cover.

c) The option to cover the aperture with a leaf screen can result in the accumulation of leaves, debris and other residue restricting the disposal of water and other residue on the pool cover.

d) The removal of accumulated leaves, debris, and other residue from the centrally located pool cover's aperture would be difficult.

e) Swimming pools to date are not manufactured with an outer assembly hole or with a preinstalled outer assembly, thus installation of the outer assembly would be required.

OBJECTS AND ADVANTAGES

Objects and advantages of the present invention are:

a) to provide a drainage apparatus allowing for drainage of water, leaves, residue, and other debris off of a swimming pool cover by means of gravity;

b) to provide a drainage apparatus allowing for the drainage of water, leaves, residue, and other debris off of a swimming pool cover by means of gravity through the skimmer opening located in the side wall of a pool;

c) to provide the means for a self-draining pool cover;

d) to provide easy installation;

e) to provide easy access to leaves, residue, and other debris on a self-draining pool cover preventing the possibility of accumulations;

f) to provide easy cleaning of a self-draining pool cover prior to removal and storage;

g) to provide drainage use of the preexisting substantial skimmer opening in the wall of a pool.

Further objects and advantages will become apparent from a consideration of ensuing description and drawings.

Figure 1:
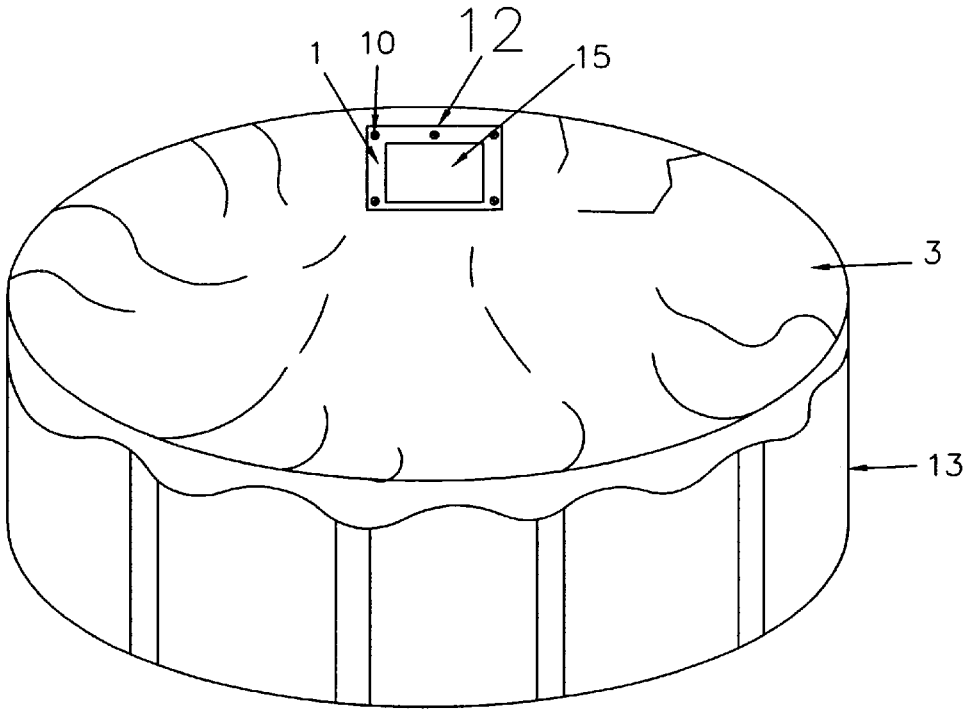
FIG. 1 is a top view of a typical pool filled with water to the height of the bottom of the skimmer opening covered by a pool cover with an installed drainage apparatus to the pool cover's aperture that is secured to the perimeter of the skimmer opening in the side-wall of the pool.

| Reference Numerals In Drawings | |
|---|---|
| 1 | top cover protruding apparatus |
| 2 | cover gasket |
| 3 | pool cover |
| 4 | bottom cover apparatus |
| 5 | assembled drainage apparatus and pool cover |
| 6 | skimmer gaskets |
| 7 | pool liner |
| 8 | pool wall |
| 9 | skimmer apparatus |
| 10 | male fasteners |
| 11 | aperture |
| 12 | installed drainage apparatus |
| 13 | typical pool |
| 14 | pool water |
| 15 | skimmer opening |
| 16 | female fasteners |
| 17 | fastener passageways |
| 18 | pool skimmer unit |
| 19 | pool skimmer seal |
| 20 | pool skimmer cover |
| 21 | pool skimmer basket |

SUMMARY

In accordance with the present invention a drainage apparatus providing for drainage of water, leaves, residue, and debris off of a swimming pool cover through the skimmer opening in the side wall of a pool by gravity.

DETAILED DESCRIPTION OF THE INVENTION

Figure 4:
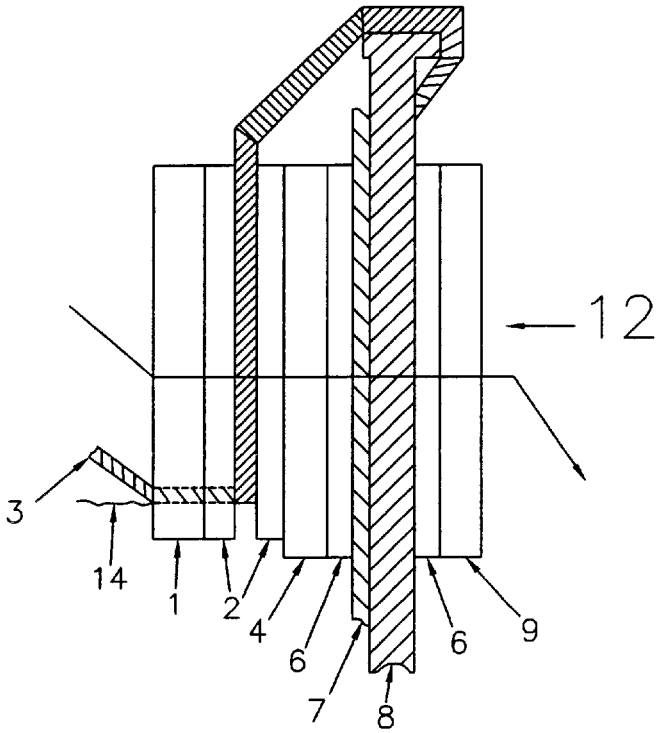
FIG. 4 shows a sectional view of an installed drainage apparatus in the side wall of a pool.
Figure 5:
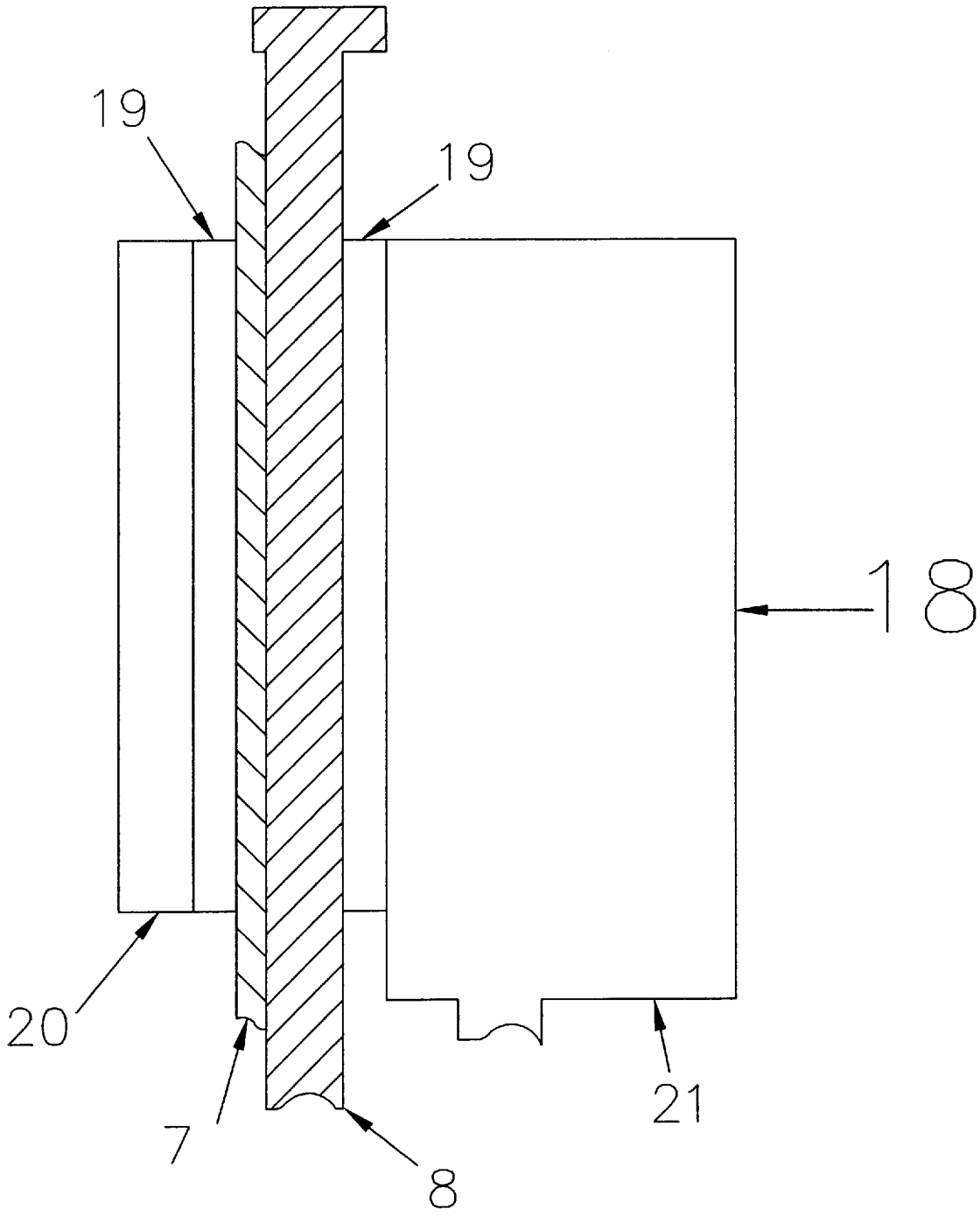
FIG. 5 shows a sectional view of an installed pool skimmer unit in the side wall of a pool.

Referring to the drawings of FIGS. 1–5 and in particular FIG. 1 illustrates a typical pool 13 covered by a pool cover 3 with an aperture 11 secured to a drainage apparatus 5. The pool water 14 height is at the bottom of the skimmer opening 15. The pool skimmer unit 18 has been removed. The drainage apparatus 5 is secured to the perimeter of the skimmer opening 15 in the pool wall 8. Accumulations on the installed drainage apparatus 12 are disposed of by gravity through the skimmer opening 15. FIG. 5 illustrates a typical pool 13 with an installed pool skimmer unit.

Figure 2:
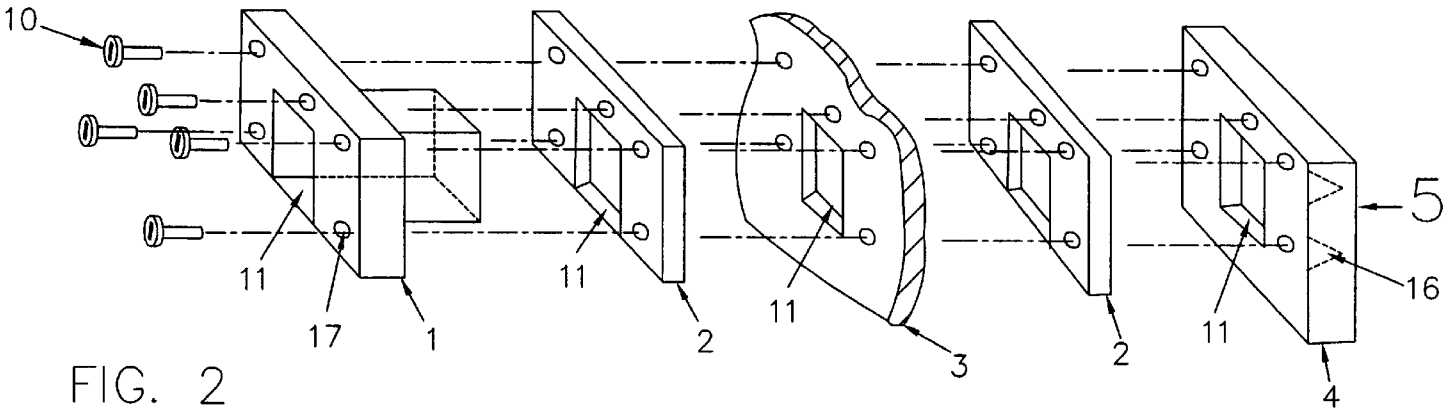
FIG. 2 shows an exploded detailed view of the drainage apparatus and a pool cover with an aperture.
Figure 3:
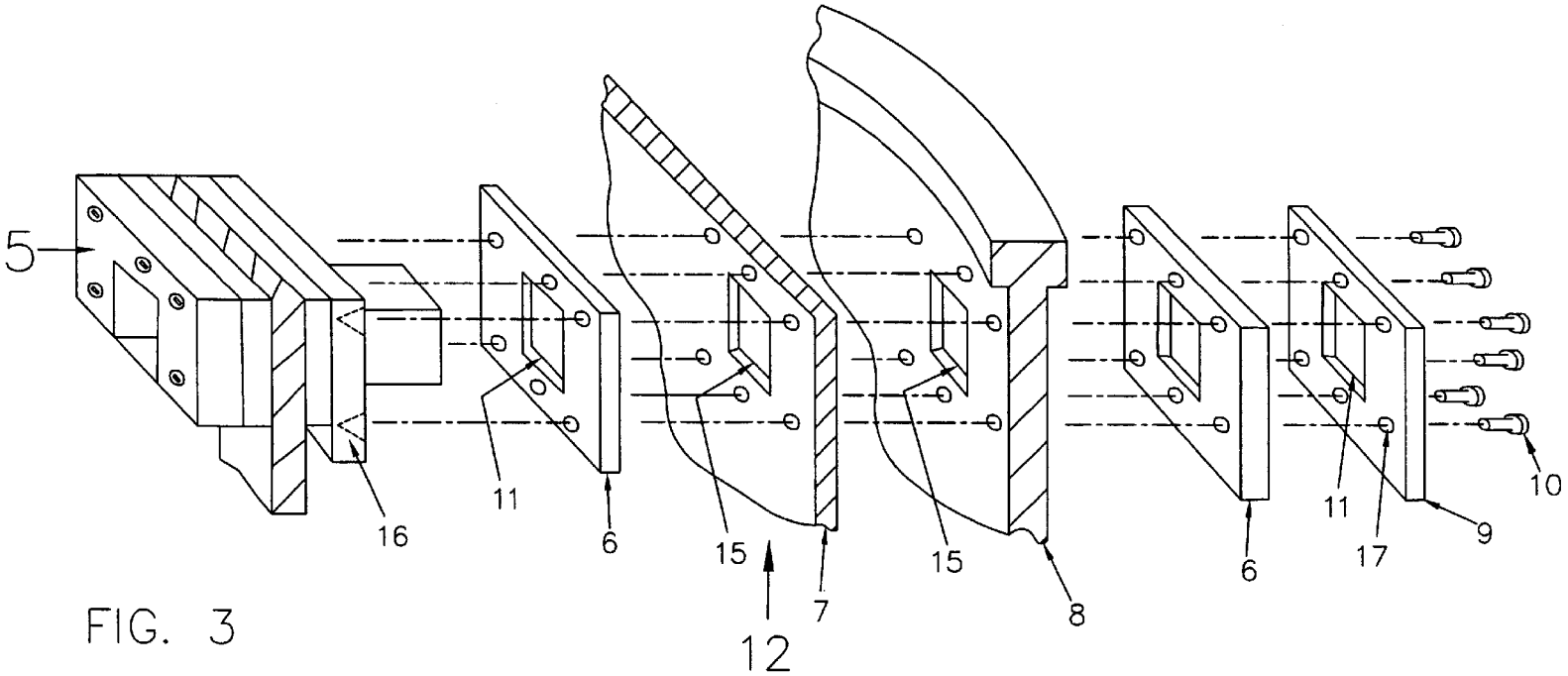
FIG. 3 shows an exploded detailed installation view of the assembled drainage apparatus and pool cover being secured to the perimeter of the skimmer opening in the side wall of the pool to the skimmer apparatus.

Specifically, in the embodiment of FIG. 1 a typical pool 13 is filled with pool water 14 up to the pool skimmer opening 15. The pool skimmer unit FIG. 5 consisting of a pool skimmer basket 21, a pool skimmer cover 20, and two pool skimmer seals 19 is unfastened and remove from the pool wall 8. A pool cover 3 has an aperture 11 the approximate size of the skimmer opening 15. A top cover protruding apparatus 1 made of plastic with an aperture 11 the approximate size of the skimmer opening 15 and a cover gasket 2 made of rubber with an aperture 11 the approximate size of the skimmer opening 15 is preferably connected as shown in FIG. 2 to the top side of the pool cover's 3 aperture 11 by connecting a cover gasket 2 and bottom cover apparatus 4 with an aperture 11 the approximate size of the skimmer opening 15 made of plastic on the opposite side of the pool cover's 3 aperture 11 secured together FIG. 3 by male fasteners 10 inserted through fastener passageways 17 secured to female fasteners 16. The assembled pool cover apparatus 5 is preferably connected as shown in FIG. 3 to the skimmer opening 15 in the pool wall 8 by use of a skimmer gasket 6 with an aperture 11 the approximate size of the skimmer opening 15 made of rubber on the pool liner 7 skimmer opening 15 connected to a skimmer gasket 6 and a skimmer apparatus 9 made of plastic with an aperture 11 the approximate size of the skimmer opening 15 on the outside pool wall 8 skimmer opening 15 secured together by male fasteners 10 inserted through fastener passageways 17 secured to female fasteners 16. FIG. 4 is a sectional view of an assembled drainage apparatus 5 connected to the skimmer opening 15 on the pool liner 7 side of the pool wall 8 connected to a skimmer gasket 6 and skimmer apparatus 9 on the outside pool wall 8 skimmer opening 15 secured together by male fasteners 10 inserted through fastener passageways 17 secured to female fasteners 16.

In using the drainage apparatus in FIG. 1 accumulations on the pool cover 3 are removed by gravity through the drainage apparatus 5 secured to the skimmer opening 15 in the pool wall 8.

This invention has major advantages over the prior art. In the prior art, a typical non-draining pool cover, water would accumulate on the pool cover surface, freeze, and cause it to break allowing accumulations to enter the pool or removing the cover when it has accumulations on it, the contaminated water can spill into the pool. In the prior art, self-draining pool covers employ the use of filters and draining devices that allows water to drain through the filters and draining devices off of the pool cover into the pool while restricting leaves, residue, and debris. Self-draining pool covers employing the use of conduit means allows water to drain off of the pool cover through a drain assembly and conduit means to the outside of the pool. Accumulations of leaves, residue, and debris on these pool covers can clog the filters, draining devices, and conduit means restricting the drainage of water off of the pool cover. The present invention avoids these difficulties by providing a drainage apparatus that employs gravity to clean the pool cover and have the accumulations drain through the skimmer opening in the side wall of the pool. Easy access to leaves, residue, and debris on the pool cover will prevent the possibility of a clog. The skimmer opening in the side wall of a pool represents a substantial opening limiting the possibility of a clog. Therefore, the invention provides for an easy, cost effective way of removing accumulations on the pool cover without pumps, siphons, conduit means or the installation of an outlet in the wall of a pool.

I do not limit myself to any particular details of construction set forth in the specification and illustrated in the accompanying drawings, as the same refers to and sets forth only the embodiments of the invention, and it is observed that the same may be modified without departing from the spirit and scope of the claimed invention.

Having thus described the invention, what is claimed as new and desired to be secured by Letters Patent is as follows:

1. A drainage apparatus for draining water, leaves, residue, and other debris off of a pool cover comprising:

a pool cover having a surface area and an aperture approximate the size of a skimmer opening located within a side wall of a pool, said aperture and the perimeter thereof adapted to be secured to the perimeter of said skimmer opening with a pool water level to the bottom of said skimmer opening when in use, whereby any accumulations on said pool cover will flow by gravity through said aperture via said skimmer opening.

2. A drainage apparatus according to claim 1 wherein said drainage apparatus includes a top protruding apparatus and a bottom cover apparatus, each having an aperture approximate the size of said skimmer opening, said top protruding apparatus and bottom cover apparatus being mounted on opposite sides of said pool cover, respectively, around said skimmer opening.

3. A drainage apparatus according to claim 1 wherein said drainage apparatus includes a passageway approximate the size of said skimmer opening connected to said skimmer opening.

4. A drainage apparatus according to claim 1 wherein said apparatus is located approximate the edge of said pool cover.

5. A drainage apparatus according to claim 1 wherein said aperture of said pool cover is secured to said skimmer opening in said pool wall through preexisting skimmer fastening holes in said pool wall.

* * * * *